United States Patent [19]

Sorenson et al.

[11] Patent Number: 4,765,247

[45] Date of Patent: Aug. 23, 1988

[54] PARACHUTE COLLAPSING SYSTEM AND METHOD FOR FLARES

[75] Inventors: Barry R. Sorenson, Providence; Roy T. Minert, Brigham City, both of Utah

[73] Assignee: Morton Thiokol, Inc., Chicago, Ill.

[21] Appl. No.: 70,473

[22] Filed: Jul. 7, 1987

[51] Int. Cl.[4] ..... F42B 4/28

[52] U.S. Cl. ..... 102/339; 102/340; 102/342; 102/345; 244/150

[58] Field of Search ..... 102/339, 340, 342, 343, 102/345; 244/142, 149, 150

[56] References Cited

U.S. PATENT DOCUMENTS

| | | | |
|---|---|---|---|
| 1,845,466 | 2/1932 | Williams | 102/337 X |
| 1,978,641 | 10/1934 | Martin | 102/340 |
| 3,113,752 | 12/1963 | Brestel | 102/340 X |
| 3,420,474 | 1/1969 | Noles et al. | 244/31 |
| 3,515,362 | 6/1970 | Richardson et al. | 244/142 |
| 3,730,099 | 5/1973 | Schopp | 102/340 X |
| 3,752,077 | 8/1973 | Roberts et al. | 102/35 |
| 3,758,055 | 9/1973 | Adams | 244/149 |
| 3,767,142 | 10/1973 | Grosgebauer | 102/340 X |
| 4,231,311 | 11/1980 | Longerich | 102/403 X |
| 4,497,765 | 10/1987 | Wimmer | 244/142 |

FOREIGN PATENT DOCUMENTS

| | | | |
|---|---|---|---|
| 565987 | 8/1975 | Switzerland | 102/339 |
| 25355 | 4/1913 | United Kingdom | 102/340 |

OTHER PUBLICATIONS

LUU-2B/B Aircraft-Deployed Illumination Flare, Morton Thiokol, Inc.

M-257 Standoff Illuminating Flate, Morton Thiokol, Inc.

*Primary Examiner*—Peter A. Nelson

*Attorney, Agent, or Firm*—James C. Simmons; Gerald K. White

[57] ABSTRACT

A tether line is connected between a rocket launched flare and the canopy of a supporting parachute to cause the parachute to collapse and fall to the earth along with the burned out flare upon release of the single support cable.

4 Claims, 1 Drawing Sheet

PARACHUTE COLLAPSING SYSTEM AND METHOD FOR FLARES

The present invention relates to flares. More particularly, the present invention relates to a method and mechanism for collapsing a parachute upon the completion of burning of an illuminating composition contained within the flare so that the parachute will not linger in the air and become a hazard to air traffic.

Flares, supported in the sky by parachutes, are deployed during military operations for night time illumination purposes such as target illumination and rescue applications. If the parachute is not collapsed after flare burnout, the parachute tends to remain in the air a relatively long period of time and constitutes a flight hazard to aircraft in the vicinity, particularly to jet aircraft that could draw a parachute into an engine.

Flares may be deployed by dropping them from an aircraft afterwhich a static line or cable extracts a center release knob, and an end cover/release mechanism is released and ejected from the flare by a spring. The end cover/release mechanism is attached by a nylon cord and pulls the parachute out into the air stream. Such a deployed flare is illustrated in FIG. 1 wherein the numeral 10 designates the flare. The parachute includes a canopy 12 and a plurality of shroud lines 14 attached to the canopy along the perimeter thereof and extending therefrom. A pair of support cables 16 and 17 are attached at one end to the other ends of the shroud lines 14 and at the other end to the flare 10 to support the flare from the parachute. As shown, about half of the shroud lines 14 are attached to one cable 16, and the other half are attached to the other cable 17. At flare burnout, an explosive bolt is caused to release one of the two support cables while the other support cable remains attached to cause the parachute to collapse and fall rapidly, clearing the air of debris which could otherwise pose a hazard to aircraft operating in the area. Such a parachute collapsing mechanism is illustrated in U.S. Pat. No. 3,515,362 to Richardson et al.

Flares may also be rocket launched. In order to provide stability to these flares during deployment, they are spin stabilized, that is, they are caused to spin over their trajectory and, as a consequence, are spinning at the time of parachute deployment. If such a flare were provided with more than one support cable, the spinning may result in the cables becoming entangled and the parachute may as a consequence prematurely collapse. Therefore, rocket launched flares have been provided with a single support cable which is attached to the flare by means of a swivel. It is of course evident that, at flare burnout, if the single support cable were released, the flare and parachute would be separated from each other, and the parachute would remain in the air and thus not fall rapidly to the ground as would be desired.

U.S. Pat. No. 1,845,466 to Williams discloses a parachute adapted for use during landing of an airplane in case of an emergency and provides a method for releasing the parachute from the airplane so that the parachute may collapse and roll away after the airplane has landed yet may remain anchored to the airplane so that the parachute will not be lost. The parachute is thus anchored to the airplane by means of a cable which is attached at one end to the upper central portion of the body of the parachute and is attached at the other end to a body portion of the airplane. During descent of the airplane, this cable extends loosely between the parachute and airplane body portion. While Williams discloses a method for collapsing and recovering a parachute after descent of an airplane to which the parachute is attached, Williams fails to teach or suggest a method or means for effecting movement of a rocket launched flare and its supporting parachute to the ground quickly after flare burnout.

U.S. Pat. No. 3,420,474 to Noles et al discloses a method for collapsing an aerodynamic decelerating vehicle such as a balloon or parachute adapted to carry a payload wherein a line or streamer of a predetermined weight is attached to the apex of the vehicle and hangs loosely over the outside of the vehicle. When a holder carrying the payload becomes less than the weight of the line, the vehicle tips over causing evacuation of the supporting air or gas and subsequent descent of the vehicle. The mechanism of Noles et al requires additional hardware in the form of a predetermined weight to be attached to the line or streamer. Furthermore, when used with a rocket launched flare, such a weight may not be adequately reliable. It is desired to provide a method and mechanism which is reliable, inexpensive, and rugged for effecting movement of a rocket launched flare and its supporting parachute to the ground quickly after flare burnout.

It is therefore an object of the present invention to effect movement of a rocket launched flare and its supporting parachute to the ground quickly after flare burnout.

It is another object of the present invention to effect such movement of a rocket launched flare and its supporting parachute to the ground quickly after flare burnout by a mechanism which is rugged, reliable, and inexpensive.

The above and other objects, features, and advantages of this invention will be apparent in the following detailed description of the preferred embodiments thereof which is to be read in connection with the accompanying drawings.

IN THE DRAWINGS

DETAILED DESCRIPTION OF THE PREFERRED EMBODIMENTS

Figure 2:
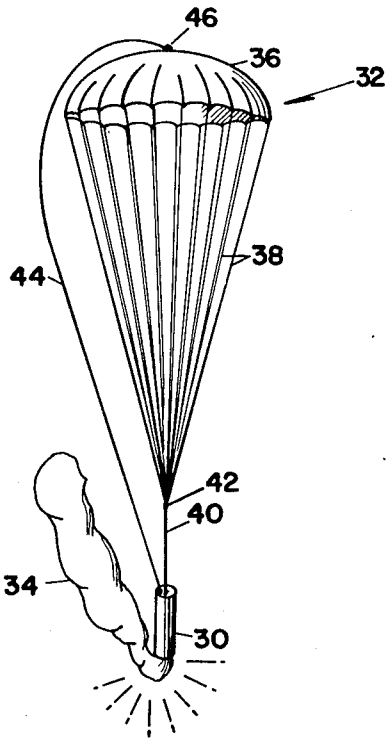
FIG. 2 is a diagrammatic view showing a flare in descent while suspended to a parachute in accordance with the present invention.
Figure 1:
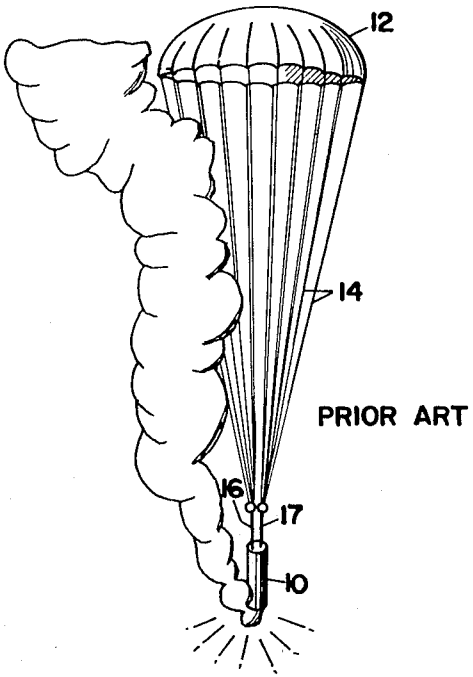
FIG. 1 is a diagrammatic view showing an illuminating device of the prior art in descent while suspended to a parachute by shroud lines.

Referring to FIG. 2, there is illustrated at 30 a rocket launched flare which is supported in the air by parachute 32 while a composition in the flare burns, as illustrated at 34, to provide illumination. The parachute 32 may be of a conventional type including a canopy 36 which provides the lifting or supporting surface of the parachute. A plurality of shroud lines 38 extend from the perimeter or edge of the canopy 36.

Rocket launched flares are spin induced to provide stability during their movement to the point of deployment. Such flares are commonly known to those of ordinary skill in the art to which this invention pertains and will not be described in any further detail herein. If more than one support cable were used to attach the shroud lines to the flare, such support cables would likely become entangled during the spinning of the flare and thus cause the parachute to not properly deploy or open or to prematurely collapse. Therefore, as shown in FIG. 2, a single support cable 40 is attached between the flare 30 and the ends of the shroud lines 38. This support cable 40 is preferably attached by means of a swivel illustrated at 42 at the junction with the shroud lines 38 to prevent twisting of the support cable 40 during spinning of the flare 30. The flare 30, parachute 32, and the attachment of the support cable 40 thereto are commonly known to those of ordinary skill in the art to which this invention pertains and will therefore not be described any further herein.

After flare burnout, it is desired to effect movement of the flare and the supporting parachute to the ground quickly. In order to achieve this result, it is desirable to collapse the parachute and to allow it to remain attached to the flare so that it can quickly fall to the ground with the flare. In order to achieve this result in accordance with the present invention, a line 44 is tethered between the flare 30 and the canopy 36, that is, the line 44 is fixedly attached at one end to the flare 30 and at the other end to the canopy 36 but it is allowed slack so that it does not exert a force on the canopy which would interfere with the function of the support cable 40 while the flare is functioning to provide illumination. The tether line 44 is preferably attached to the canopy 36 at the apex 46 or center point thereof so that the tether line may freely rotate about the parachute.

Figure 3:
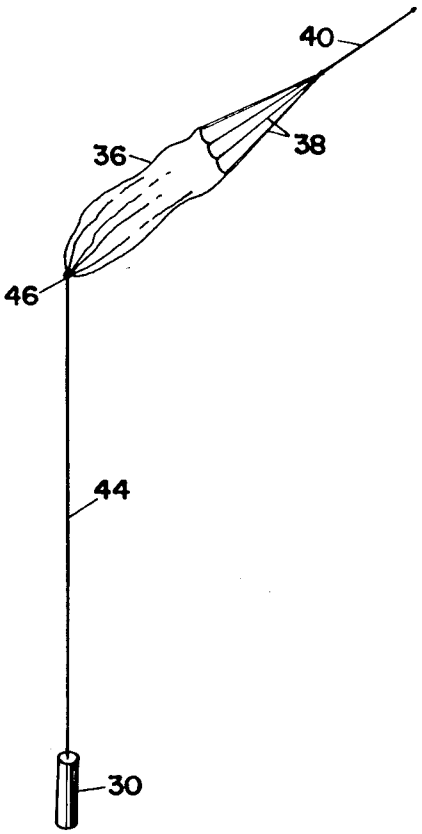
FIG. 3 is a diagrammatic view showing the parachute of FIG. 3 in a collapsed condition in accordance with the present invention.

After flare burnout, the single support cable 40 is released by a heat-activated device such as an explosive bolt (not shown) or other means commonly known to those of ordinary skill in the art which this invention pertains. Referring to FIG. 3, the tether line 44 remains attached to the flare 30 and, as illustrated therein, causes the parachute to collapse and fall quickly to earth with the flare 30.

It is to be understood that the invention is by no means limited to the specific embodiments which have been illustrated and described herein, and that various modifications thereof may indeed be made which come within the scope of the present invention as defined by the appended claims.

We claim:

1. A method of effecting movement of a rocket launched flare and its supporting parachute to the ground quickly after flare burnout comprises the steps of:

a. tethering a line between the flare and the apex of the parachute canopy and including release means for said line so that, upon release of support means attaching the flare to the parachute for supporting of the flare for slowing of its descent, the parachute will collapse, and b. releasing the support means.

2. In combination with a rocket launched flare, a parachute including a canopy having an apex and a plurality of shroud lines extending from the canopy, and support means comprising a single cable for attaching the flare to the shroud lines, a tether line connected between the flare and the apex of the canopy, said tether line including release means whereby, upon release of the support means, the parachute will collapse.

3. A method according to claim 1 wherein the release means is heat-activated.

4. The combination according to claim 2 wherein said release means is heat-activated.

* * * * *

UNITED STATES PATENT AND TRADEMARK OFFICE

CERTIFICATE OF CORRECTION

PATENT NO. : 4,765,247

DATED : August 23, 1988

INVENTOR(S) : Sorensen et al.

It is certified that error appears in the above-identified patent and that said Letters Patent is hereby corrected as shown below:

On the title page, the name of the inventor Barry R. Sorenson should be --Barry R. Sorensen--.

Signed and Sealed this

Twenty-sixth Day of December, 1989

*Attest:*

JEFFREY M. SAMUELS

*Attesting Officer*

*Acting Commissioner of Patents and Trademarks*